United States Patent [19]

Young

[11] 4,167,210

[45] Sep. 11, 1979

[54] ELECTRIC HEAT MODULE MOUNTING ARRANGEMENT FOR ROOF TOP TYPE AIR CONDITIONING UNIT

[75] Inventor: Robert R. Young, Murrysville, Pa.

[73] Assignee: Westinghouse Electric Corp., Pittsburgh, Pa.

[21] Appl. No.: 853,987

[22] Filed: Nov. 23, 1977

[51] Int. Cl.[2] ..... F24H 3/00

[52] U.S. Cl. ..... 165/47; 165/58; 62/DIG. 16

[58] Field of Search ..... 165/58, 59, 47, 2; 62/DIG. 16

[56] References Cited

U.S. PATENT DOCUMENTS

| | | | |
|---|---|---|---|
| 2,934,323 | 4/1960 | Burke | 165/12 |
| 3,017,160 | 1/1962 | Lee et al. | 165/47 X |
| 3,186,477 | 6/1965 | Bell | 165/2 |
| 3,220,212 | 11/1965 | Fordsmand | 62/288 |
| 3,529,659 | 9/1970 | Trask | 165/29 |
| 3,731,056 | 5/1973 | Becker | 219/361 |

*Primary Examiner*—Edgar W. Geoghegan
*Attorney, Agent, or Firm*—E. C. Arenz

[57] ABSTRACT

The open-face frames of electric heat modules used with a pair of centrifugal fans in a roof top type air conditioning unit are mounted with their upwardly open faces spaced downwardly away from the downwardly facing discharge opening of the fans, rather than up tight against the discharge opening, so that there will be a bypass of at least some of the discharge air from the fan around the module to reduce the resistance to air flow imposed by the module. The arrangement achieves a good balance between the use of relatively high watt density heater while avoiding undue resistance to air flow through the heater. The invention also provides a convenient module mounting arrangement in which the inboard end walls of the modules are supported in a complementary hook and eye arrangement with mounting straps depending from the sides of the discharge openings of the centrifugal fans.

4 Claims, 7 Drawing Figures

ELECTRIC HEAT MODULE MOUNTING ARRANGEMENT FOR ROOF TOP TYPE AIR CONDITIONING UNIT

CROSS REFERENCE TO RELATED APPLICATION

Lackey U.S. patent application Ser. No. 853,989, filed Nov. 23, 1977 now Pat. No. 4,139,053 (W.E. 47,464) is a related application in the sense that it is directed to the general structural arrangement of a roof top unit to which this invention is particularly applicable.

BACKGROUND OF THE INVENTION

1. Field of the Invention

The invention pertains generally to the art of air conditioning units which utilize supplemental electric resistance heating, and pertains in particular to roof top type air conditioning units in which supplemental electric resistance heat is provided.

2. Description of the Prior Art

The use of electric resistance heat in air conditioning units, including those which are operable as heat pumps, is of course well known as evidenced by the disclosures in U.S. Pat. Nos. 2,934,323, 3,186,477, 3,220,212, 3,529,659 and 3,731,056. For the most part these patents relate to small unit or window type air conditioning units and none of them appear to be concerned with the particular problems of providing frame type electric heating modules in a satisfactory mounting arrangement in a roof top air conditioning unit and under the current constraints relating to power consumption problems. In that connection, a discussion of some of the background problems leading to the invention is considered warranted.

Some of the design considerations pertinent to my invention are set forth in the noted Lackey application and reference should be had thereto for a part of the background.

Electric heat modules, by which is meant a box type frame containing electric resistance heating elements therein and open on both the top and bottom, are readily available in various sizes and capacities such as from the Tuttle Electric Products Division of Emerson Electric Co. It is desirable generally to locate such modules in a position where relatively high velocity air flows over the resistance element so that the modules can be relatively compact and have a high watt density. If a module having a relatively high watt density is located in a position in which the air flow velocity is too low, the heaters will overheat and cut out. However, another consideration is that a relatively high watt density heater will impose a greater resistance to air flow than a relatively low watt density heater occupying the same area transverse to the air flow. The problem of increased resistance to the air flow arising from the use of high watt density heaters in a frame or box can of course be solved by increasing the fan power to get the required air flow. However, in these times in which energy conservation is a prime consideration and the requirements of achieving at least certain specified EER's (which also includes fan power as an element), it is desirable to keep the power consumption of the fans as low as possible.

In the case of the roof top type air conditioning unit disclosed in the noted Lackey patent application, the logical place to place the electric heater modules is tightly up against the discharge openings of the centrifugal fans so that high watt density heater modules may be used. However, within the constraints of the basic roof top air conditioning unit to which the heater elements are to be applied, the resistance to air flow with the modules up tight is sufficiently high that a higher horsepower motor would be required to get the necessary air flow through the indoor air flow section of the unit. The larger fan motor horsepower required would then penalize the EER. A solution to the excessive air flow resistance is to use modules having a larger face area with lower watt density heaters therein and then provide an opening transition duct from the fan discharge to the larger face area modules. While such a move would solve the problem, it imposes its own penalties in that the lower watt density heaters use more wire because of the lower velocity air flow by the heating elements, and also the addition of a transition duct is costly. My invention does not take that approach but does solve the problem even though the relatively high watt density modules are still used.

As will also become apparent from the following material, the invention also provides a mounting arrangement which permits the easy addition of the heater modules to a roof top unit subsequent to its manufacture.

SUMMARY OF THE INVENTION

In accordance with the invention the supplemental electric heat arrangement for a roof top type air conditioning unit having an indoor air flow section in which the refrigerant coil thereof is mounted upstream of at least a pair of indoor air fans with downwardly directed discharge openings includes at least one electric heat module for each fan, with each module including an upwardly and downwardly open-face frame with electric resistance heaters therein, the open-face area of each frame being generally coextensive with the area of a discharge opening of the fan, and means mounting at least one module below each discharge opening with the open upper face of the module being spaced downwardly sufficiently from the respective discharge opening of the fan to permit the bypass of at least some of the discharge air from the blower around the frame to thereby reduce the resistance to air flow imposed by the module. Further, the frame is generally open along at least one side to further reduce resistance to air flow and the modules are suspended from depending straps which, along with the inner end walls of the modules, have complementary hook and eye connection means.

DRAWING DESCRIPTION

DESCRIPTION OF THE PREFERRED EMBODIMENT

Figure 1:
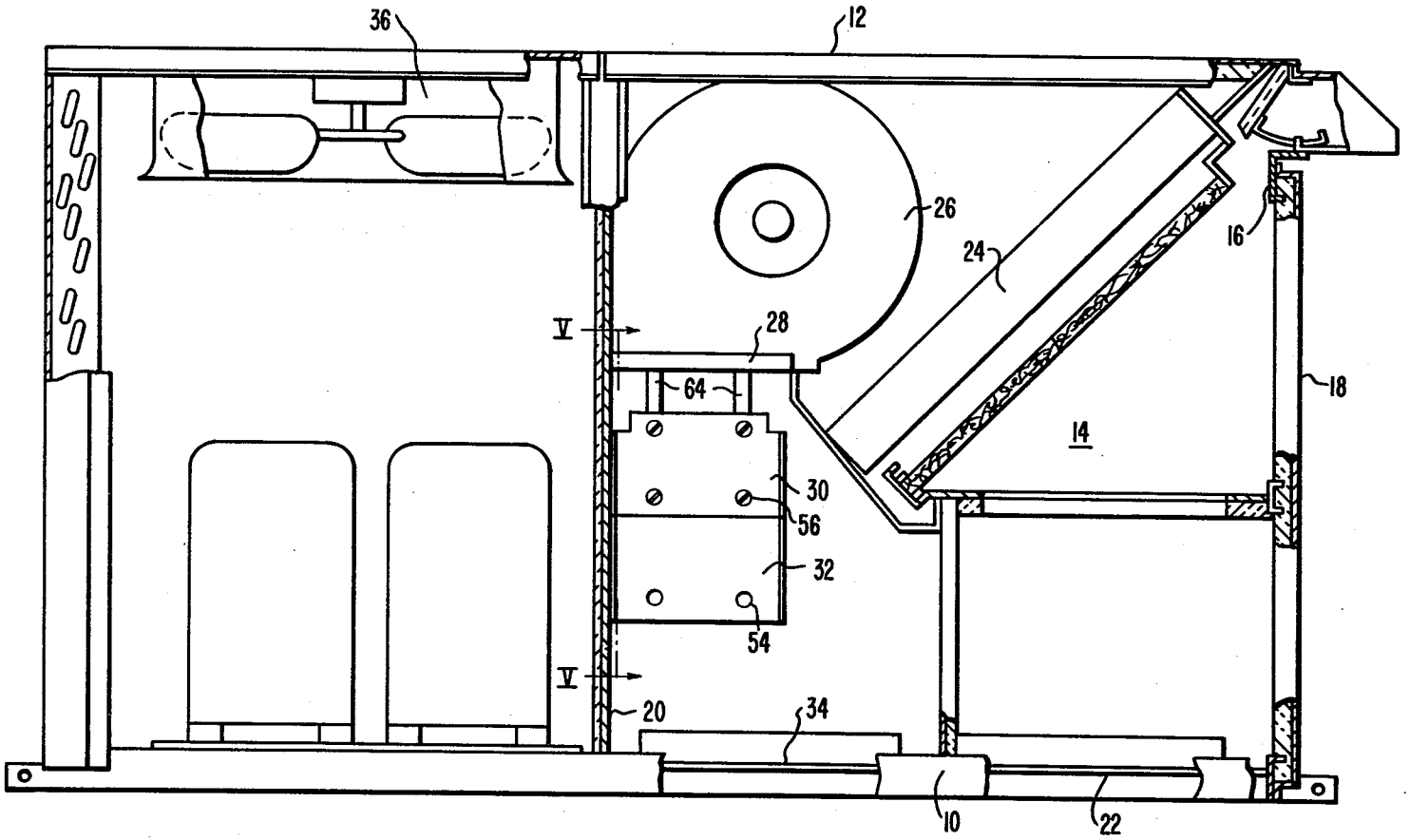
FIG. 1 is a partly-broken side view of a roof top air conditioner with the heater arrangement according to the invention, and with the indoor air section open on the side facing the viewer.

The overall construction of the indoor air section of the roof top air conditioner of FIG. 1 is described in the noted Lackey patent application. For purposes of description for this application, the basic arrangement of the indoor air section without resorting to details is deemed adequate. The indoor air flow section in FIG. 1 includes an outer cabinet comprising base wall 10, top wall 12, opposite side walls 14 (only the far one of which is shown in FIG. 1), exterior end wall 16 including removable end panel 18, and interior end wall comprising the vertical partition 20. The indoor air flow section is shown in FIG. 1 as arranged for a vertical air flow mode such as occurs when the roof top unit is installed upon a roof top with return air to the unit entering opening 22 in the base wall and being drawn through the refrigerant coil 24, which operates as an evaporator in a cooling operation and as a refrigerant condenser in a heating operation. The air flow is created by centrifugal fans 26 which force the air out of the discharge opening 28 of each fan from whence it flows through and past the electric heat modules 30 and 32 and out the supply opening 34 in the base wall to the served space.

The outdoor air flow section includes the usual refrigerant compressors, refrigerant coil and condenser fans 36.

Figure 2:
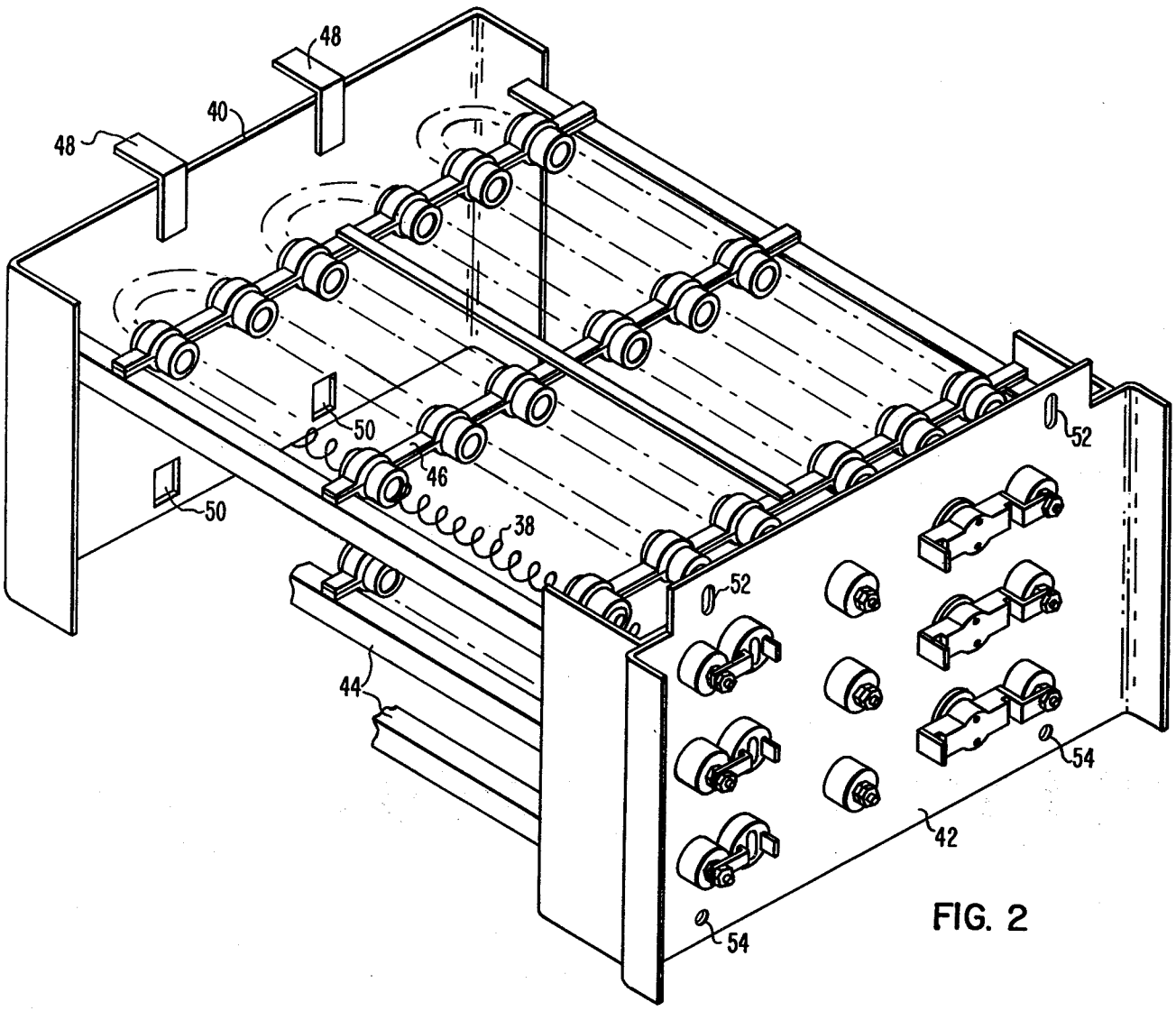
FIG. 2 is a partly broken isometric view of the frame arrangement of an electric heat module which may be used in carrying out the invention.
Figure 3:
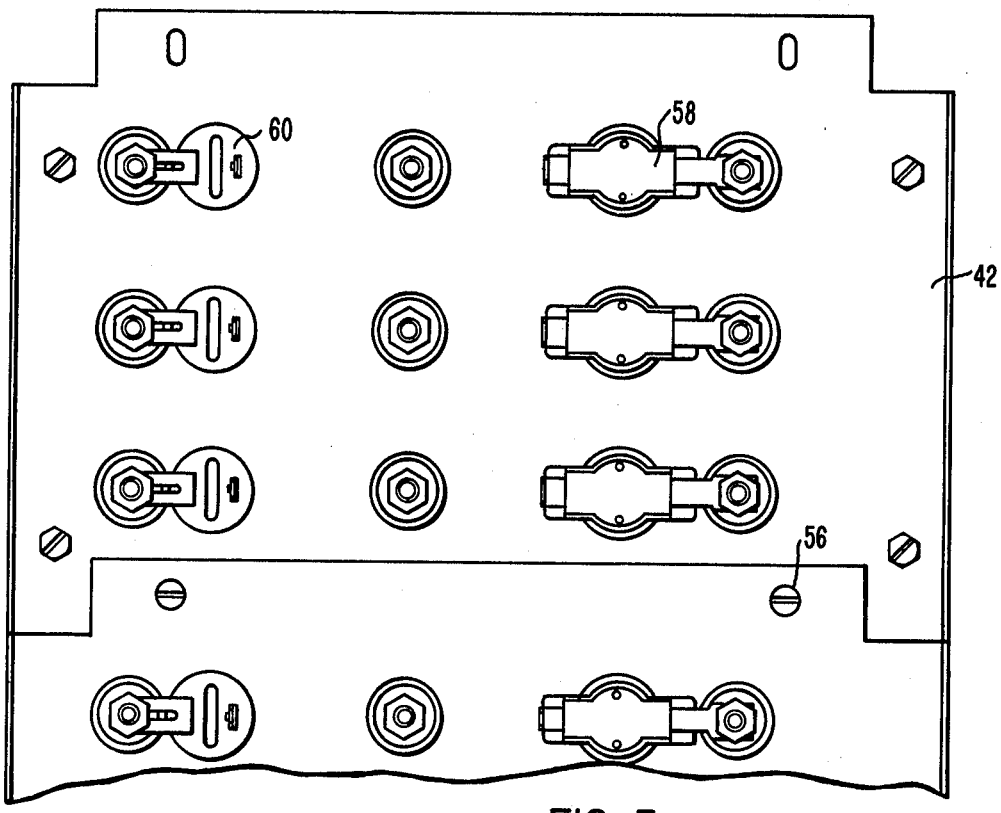
FIG. 3 is a face view of the outboard end of an electric heat module in stacked attached relation to another module.
Figure 4:
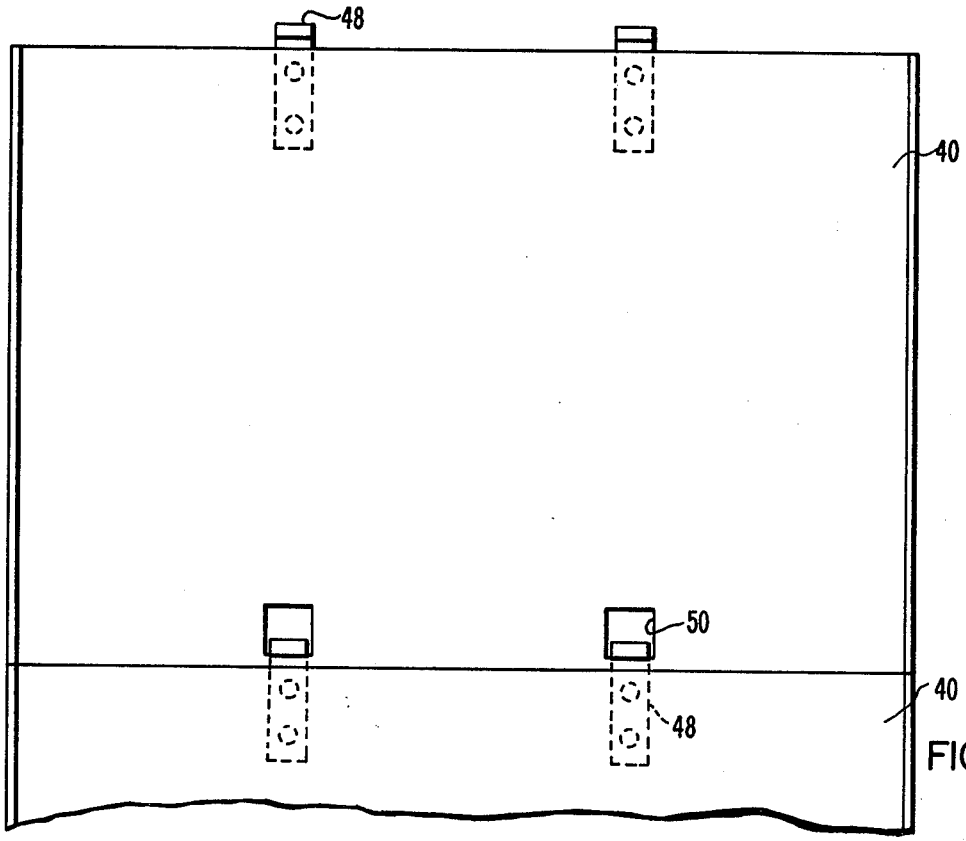
FIG. 4 is a face view of the inboard end wall arrangement of the modules of FIG. 3.

Referring to FIGS. 2–4, the basic frame arrangement used for carrying out the invention is illustrated in FIG. 2 with only a short length of the serpentine heating elements 38 shown within the frame. The frame is generally rectangular in plan outline and includes an inner end wall 40 and outer end wall 42, and sides comprised of spaced-apart angles 44 which extend between the inner and outer end walls and in turn support cross members 46 which carry the heating elements 38 having the conventional serpentine form. Both the top and bottom faces of the frame are open.

It is my understanding that ordinarily the sides of the module in its normal commercial form are closed to insure that the air to be heated is confined within the module. In accordance with this invention, the sides are basically open with only the structural angles 44 being present along the sides. The inner end wall 40 of the module includes a pair of hooks 48 in the form of right angles, each angle having its one leg secured to the end wall and its other leg projecting as shown in FIG. 2. Adjacent the other horizontal edge of the end wall 40, a pair of openings 50 are provided in correspondingly spaced-apart relation and are adapted to receive the projecting legs of the hooks 48 when the modules are connected in stacked relation as in FIG. 4.

The outer end wall 42 of each module (FIGS. 2 and 3) includes an upwardly extending flange provided with slotted holes 52 therein, and has small holes 54 correspondingly spaced apart adjacent the lower edge of the end wall. When modules are stacked as in FIG. 3, a sheet metal screw 56 may be driven through each of the slotted holes and into the round hole 54 to hold the outer end walls of stacked modules together. FIG. 3 also shows that located on the exterior of the outer end wall 40 are terminals for making the electrical connections, as well as a series of thermostats 58 and fuses 60, one each for each individual resistance heating element.

Figure 5:
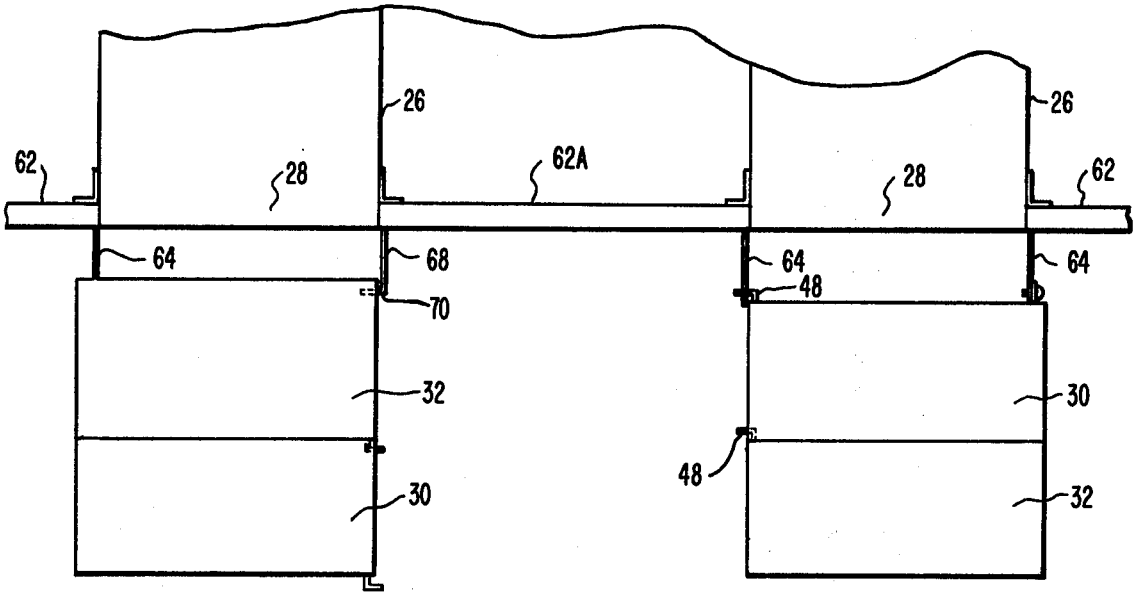
FIG. 5 is a somewhat schematic elevation view of a pair of modules mounted below each of the discharge openings of the blowers and as would be viewed from the plane of line V—V of FIG. 1.
Figure 6:
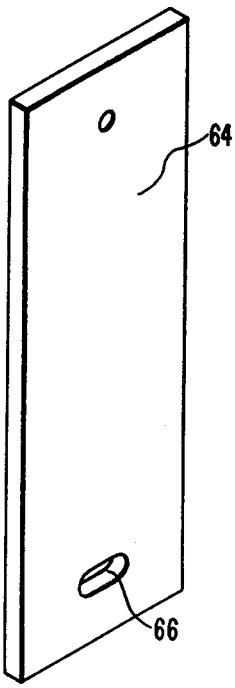
FIGS. 6 and 7 are isometric views of two forms of straps.

Referring now to FIG. 5, the manner in which one or more modules are suspended from each fan outlet 28 will be described. As is seen in FIG. 5, the two blowers 26 are spaced apart and are supported upon a horizontal shelf 62 which extends from side to side of the indoor air flow section and includes a central part 62A between the fans. A pair of spaced-apart hanger straps are provided to depend from both the inboard and outboard sides of each of the discharge openings. One form of hanger strap 64 as shown in FIG. 6 is used at both the inboard and outboard sides of the right blower as shown in FIG. 5, and the outboard side of the left blower of FIG. 5. The strap 64 is simply a flat member with an elongated opening 66 in its lower end to receive the projecting leg of a hook 48. The two inboard straps 64 are of course spaced apart the correct distance so that the correspondingly spaced hooks 48 are received in the openings 66. The outboard straps 64 are spaced farther apart so that screw fasteners of the same type as 56 (FIG. 3) used to hold modules together may be used to hold the upper flange of the outer wall 42 to the straps 64.

Figure 7:
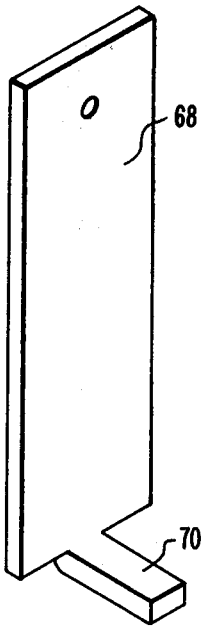

The inboard strap 68 for the left blower of FIG. 5 is of a shape as shown in FIG. 7 which includes a lug or hook 70 at the lower end of the strap as it is installed. The right and left modules for the two blowers are not installed in simply mirror image relationship, but are also inverted one relative to the other. The reason for this is to locate the thermostatic elements 58 in line with that part of the discharge opening which produces the highest velocity of air, this of course in the case of a centrifugal fan being toward the side of the discharge opening opposite the cutoff. This is readily accomplished as may be seen in FIG. 5 by inverting the modules on the left relative to those on the right. Then by using the special strap 68 with the hook 70, this hook will nicely engage the openings 50 adjacent the one horizontal edge of the inner end wall of the upper module 32 in FIG. 5.

The hook and eye arrangement for the inboard connections facilitates the assembly of the modules to a standard roof type unit which is stocked by a distributor along with the modules described. First, both opposite side panels 14 of the indoor section are removed and the hangers 64 and 68 installed from the sides. Then the module or modules to be installed are simply moved into position from each of the opposite sides with their inner end walls being engaged in the hook and eye connection, and a screw fastener is applied to hold the outer end walls to the outer straps.

With the arrangement as described, the high velocity discharge air from the fans passes down through the modules as well as bypasses to a degree through the gap of the height of the hangers. The air is also permitted to bypass to a degree through the one open side of the modules opposite the vertical partition 20, that partition serving generally to confine air to the cross sectional area of the module at that side. As a result the resistance to air flow imposed by the modules is significantly less than if the modules were totally enclosed around the sides and ends and tightly up against the discharge openings. At the same time, the air that does pass through the heaters is heated sufficiently that as it mixes with the bypassing air downstream from the modules and on the way to the served space, adequate heat is supplied to the air as a whole.

I claim:

1. In a roof top type air conditioning unit having an indoor air flow section in which the refrigerant coil thereof is mounted upstream of at least a pair of indoor air blowers having downwardly directed discharge openings, a supplemental electric heat arrangement comprising:

at least one electric heat module for each blower, each module including opposite end walls forming a part of an upwardly and downwardly open-face frame containing electric resistance heaters therewithin, the open-face area of each said frame being generally coextensive with the area of a discharge opening of a blower;

means mounting at least one module below each discharge opening of a blower and in general alignment therewith with the upper open face of the module being spaced downwardly from the respective discharge opening of the blower to permit the bypass of at least some of the discharge air from the blower around the frame to reduce the resistance to air flow imposed by said module.

2. In a unit according to claim 1 wherein:

said frame is generally open along at least one side thereof to further reduce resistance to air flow.

3. A unit according to claim 1 wherein said mounting means comprises:

a pair of spaced-apart hanger straps depending from both the inboard and outboard sides of each discharge opening, the lower ends of said inboard straps and the inner end walls of said modules having complementary hook and eye connection means; and means to connect the outer end walls to the outboard straps.

4. A unit according to claim 3 wherein:

the inner end walls of each module includes a pair of outwardly projecting hooks spaced apart along one horizontal edge of said inner end walls and a pair of correspondingly spaced-apart openings adjacent the other horizontal edge of said inner end walls, said hooks and said openings selectively cooperating in connecting modules in stacked relation, and in mounting to said straps.

* * * * *